United States Patent [19]

Troy

[11] 4,381,805

[45] May 3, 1983

[54] SIMULATED GRASS PILE FABRIC

[75] Inventor: James E. Troy, Eden, N.C.

[73] Assignee: Fieldcrest Mills, Inc., Eden, N.C.

[21] Appl. No.: 232,895

[22] Filed: Feb. 9, 1981

[51] Int. Cl.[3] ..... D03D 27/00; D03D 27/06; D04B 21/02

[52] U.S. Cl. ..... 139/391; 139/402; 139/420 R; 66/191; 66/194; 66/202; 428/17; 428/92; 57/907

[58] Field of Search ..... 139/391, 401, 402, 420 R, 139/46; 66/191, 194, 202; 428/17, 85, 92, 93, 97; 28/159, 170; 112/410; 57/907

[56] References Cited

U.S. PATENT DOCUMENTS

| | | | |
|---|---|---|---|
| 3,213,646 | 10/1965 | Van Patten | 66/191 |
| 3,332,828 | 7/1967 | Faria et al. | 428/17 |
| 3,611,699 | 10/1971 | Wininger, Jr. et al. | 57/907 X |
| 3,732,708 | 5/1973 | Troy | 66/194 X |
| 3,739,567 | 6/1973 | Williamson | 57/907 X |
| 3,740,303 | 6/1973 | Alderson et al. | 428/97 X |
| 3,788,364 | 1/1974 | Dawbarn | 139/420 R |
| 3,837,980 | 9/1974 | Nishimura et al. | 428/92 X |
| 3,940,522 | 2/1976 | Wessells | 428/17 |
| 4,007,307 | 2/1977 | Friedrich | 428/17 |
| 4,061,804 | 12/1977 | McCulloch | 428/17 |
| 4,323,612 | 4/1982 | Van Issum | 428/92 X |

*Primary Examiner*—James Kee Chi

*Attorney, Agent, or Firm*—Bell, Seltzer, Park and Gibson

[57] ABSTRACT

The simulated grass pile fabric of this invention is of the woven or warp knit type and is characterized by having a dense pile surface defining a playing surface on which a playing ball will roll substantially equally free in all directions and will bounce substantially equally true in all directions, and the pile surface is formed of textured multifilament pile yarns of a yarn size greater than 4500 denier interlaced with a base of synthetic warp and filling yarns, wherein the warp yarns are of a yarn size in the range of about 1300 to 2200 denier and the filling yarns are fibrillated monofilament yarns of a yarn size in the range of about 2200 to 4400 denier.

10 Claims, 14 Drawing Figures

SIMULATED GRASS PILE FABRIC

FIELD OF THE INVENTION

This invention relates to pile fabrics, and more especially to an improved simulated grass pile fabric of the woven or warp knit type for playing a variety of ball games and other sports thereon.

BACKGROUND AND SUMMARY OF THE INVENTION

As is generally known, during recent years, artificial turf of simulated grass has become of quite widespread use both indoors and outdoors for a variety of sports and other recreational activities. However, the known types of grass-like artificial turf have presented various problems and difficulties in use, such as for example, the inhibited or relatively unyielding character of the grass-like components to a player moving thereover in one direction and the relatively slippery surface presented by the grass-like components to a player moving in the respective opposite direction, and the sparsity of the grass-like components with consequent undesirable fading and/or discoloration of the pile and with portions of the fabric base or substrate thereof being exposed between adjacent pile tufts or grass-like components at times during trampling thereof by spiked or cleated shoes.

Therefore, it is an object of this invention to provide an improved simulated grass pile fabric which avoids the above and other problems presented by simulated grass pile fabrics heretofore.

Still another object is to provide an improved simulated grass pile fabric of the woven or warp knit type for playing a variety of ball games and other sports thereon, wherein the pile of the fabric is substantially macroscopically devoid of any grain or direction of lay of the pile tufts to thereby present a playing surface on which the playing ball rolls substantially equally free in all directions and bounces substantially equally true in all directions to provide for the safer playing of sports thereon.

BRIEF DESCRIPTION OF THE DRAWINGS

Some of the objects of the invention having been stated, other objects will appear as the description proceeds when taken in connection with the accompanying drawings in which.

DETAILED DESCRIPTION

Figure 1:
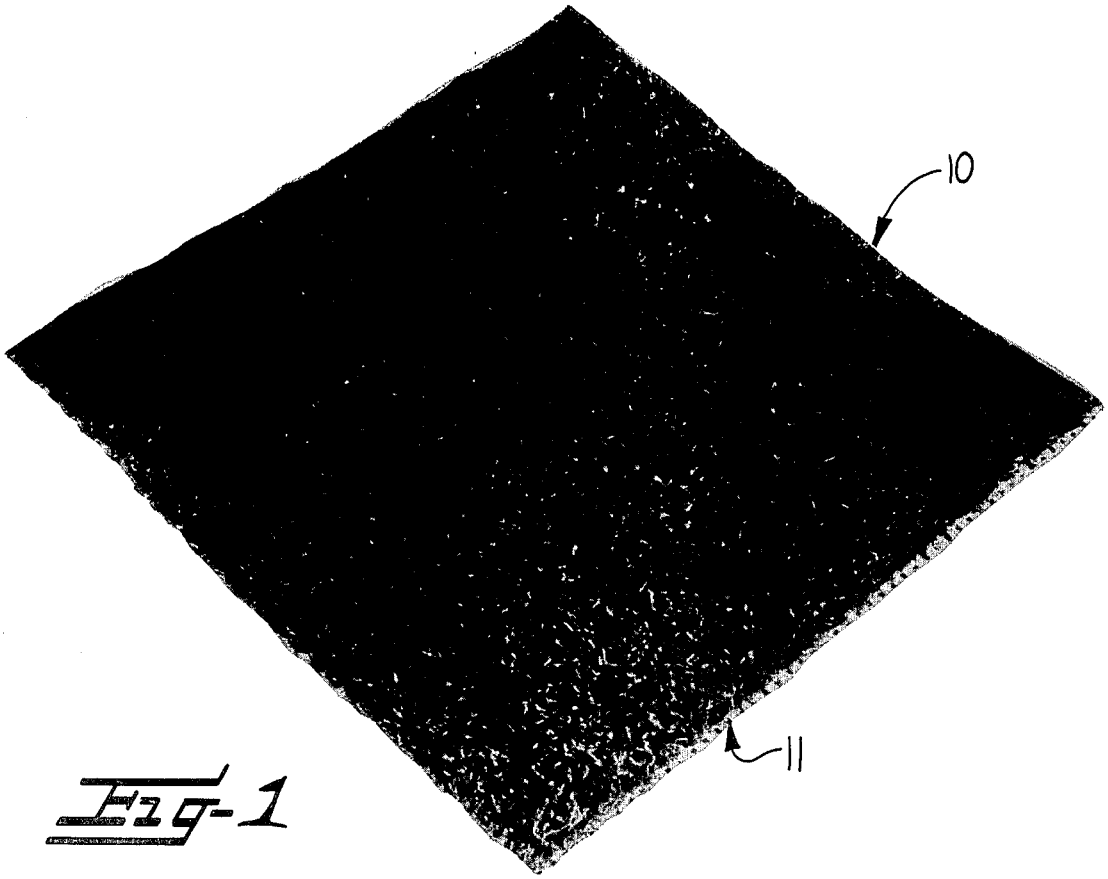
FIG. 1 is a photographic view of the pile surface of a woven embodiment of the improved simulated grass pile fabric of the present invention.

Referring more specifically to the drawings, two embodiments of the improved simulated grass pile fabric of this invention are illustrated therein, both of which are provided with respective pile surfaces having the desired characteristics set forth above. The first embodiment is a woven type fabric generally designated at 10 (FIGS. 1–5), and the second embodiment is a warp knit type fabric generally designated at **10*a* (FIGS. 6–11**).

According to the invention, the illustrated embodiments of the fabric 10, **10*a* comprise respective bases or ground fabrics 11, 11*a* of interlaced warp yarns 12, 12*a* and filling yarns 13, 13*a*, and pile yarns 14, 14*a* extending upwardly from the bases 11, 11*a* and defining cut pile tufts forming a pile face on each of the fabrics 10, 10*a*. Referring particularly to the woven fabric 10 shown in FIGS. 1–5, the warp yarns 12 of the woven fabric 10 are tightly interwoven with the filling yarns 13 and with the pile yarns 14 looped beneath the filling yarns 13, somewhat in the manner of the one-shot pile fabric disclosed is U.S. Pat. No. 2,860,669 of Nov. 18, 1958, for example, so as to provide a base 11** of high density as well as an upstanding cut pile face of high density.

As disclosed in the latter patent, a woven one-shot or single-shot pile fabric is formed on a weaving machine or loom by repeating successive weaving cycles which may include, for example, dipping guides for the respective pile yarns downwardly into the shed formed of the warp yarns, inserting a weft or filling yarn through the warp shed and over the pile yarns, then raising and shogging the pile yarn guides weftwise over and across respective warpwise extending pile wires and respective groups of the warp yarns, and beating up the filling yarn to complete each weaving cycle. As the successive weaving cycles are performed, the pile yarns 14 are under tension and they trace respective zig-zag paths as represented schematically in the medial portion of FIG. 3, all of which is well known to those familiar with the weaving arts.

Figure 2:
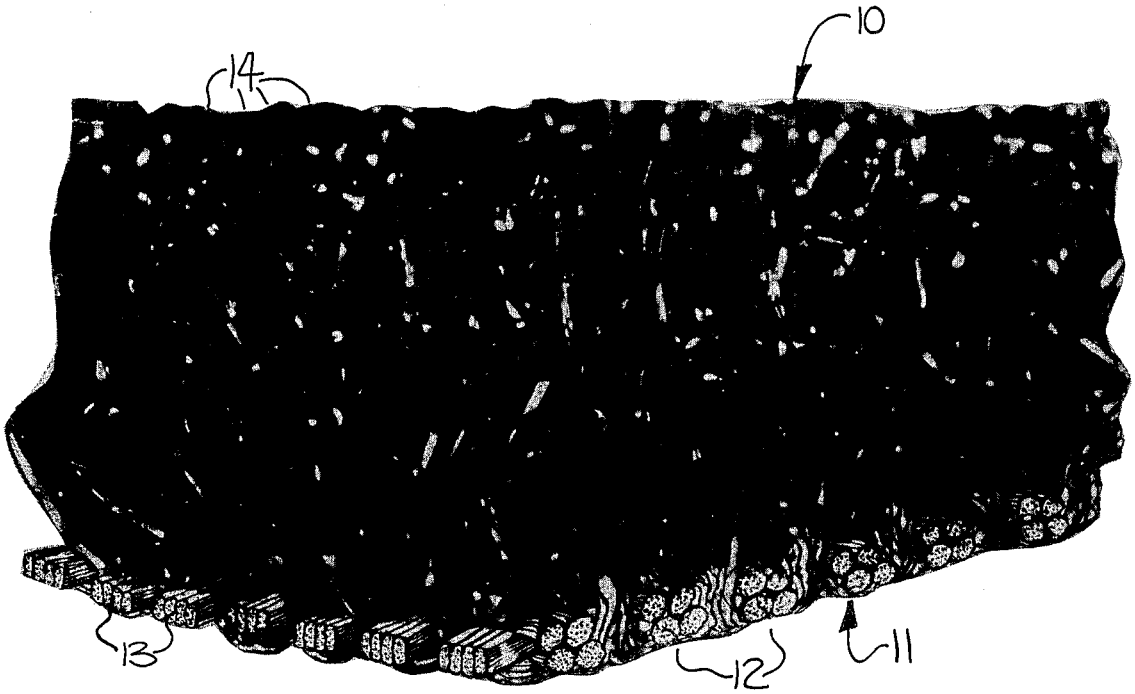
FIG. 2 is an enlarged photographic view of the lower corner portion of the pile fabric shown in FIG. 1.
Figure 3:
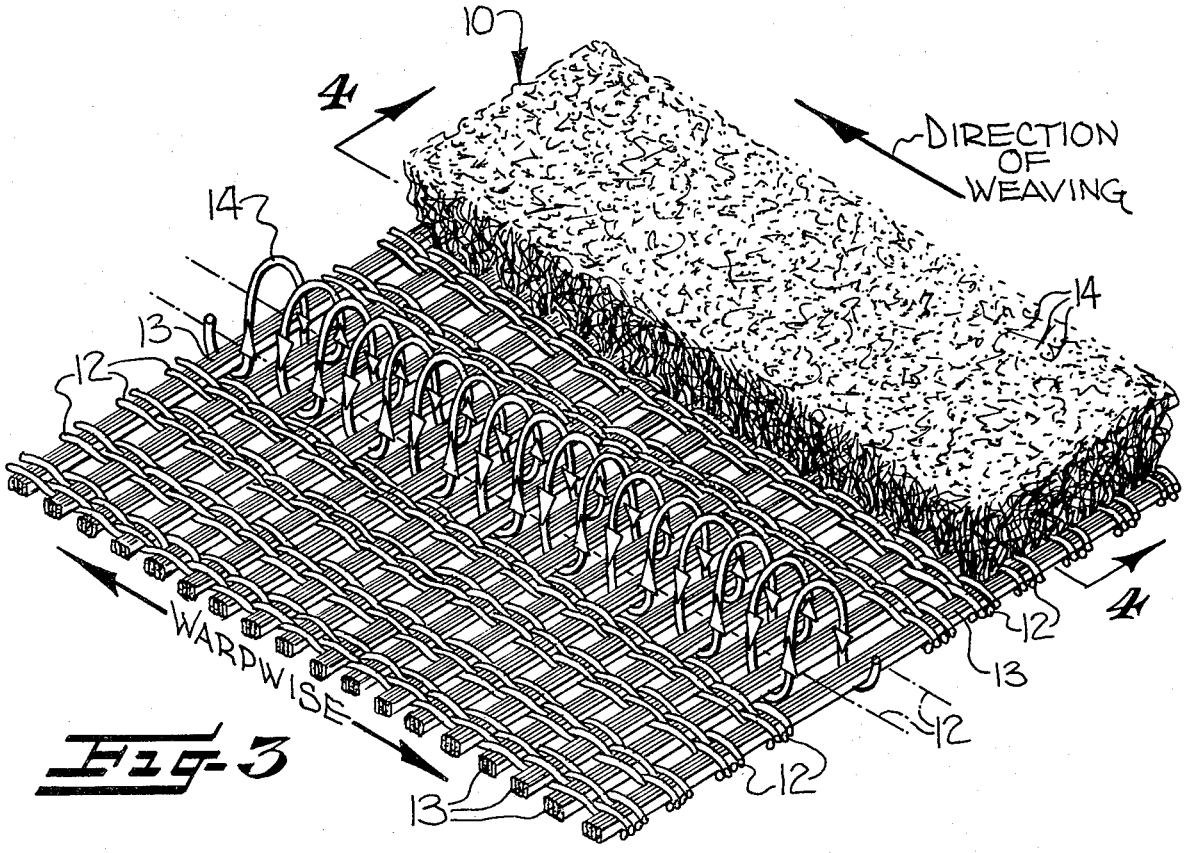
FIG. 3 is a schematic perspective view illustrating adjacent portions of the fabric of FIG. 1 to show (a) the base or ground fabric only, (b) the pile tufts prior to cutting the same, and (c) the completely formed woven fabric with cut pile tufts.
Figure 4:
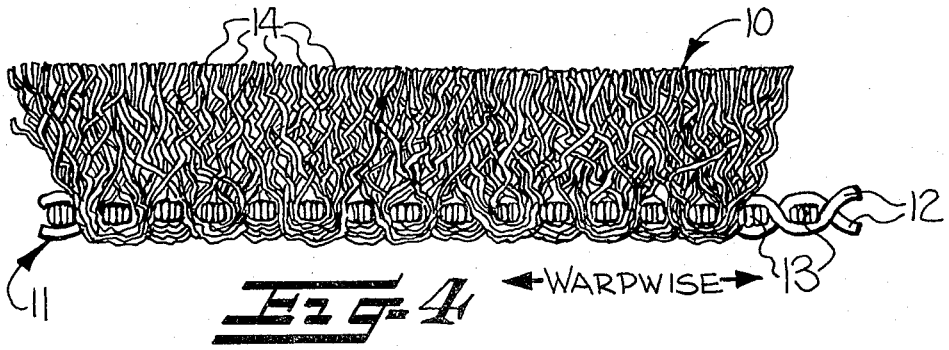
FIG. 4 is a warpwise sectional view taken substantially along line 4—4 in FIG. 3.
Figure 5:
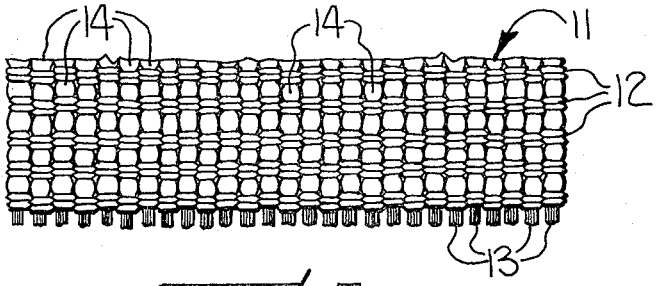
FIG. 5 is a back or bottom view of the woven pile fabric shown in FIG. 1.

As best illustrated in FIG. 5, it is to be noted that the groups of warp yarns 12, commonly known as chain warps, are positioned quite close together so as to pinch and bind the lower bights of the tufts being formed of the pile yarns 14 to the base 11. The loops thus formed of the pile yarns 14 (as shown in the medial portion of FIG. 3) preferably are of generally uniform height and may be cut during weaving, or by shearing the pile loops in a well-known manner, to form the simulated grass cut pile surface of the woven fabric 10 as illustrated in FIGS. 1 and 2, the right-hand portion of FIG. 3, and in FIG. 4. Thereafter, a suitable backing material, such as latex, is applied to the back of the fabric 10 to stabilize the same and to aid in locking the tufts in the base 11.

In order to obtain simulated grass pile fabrics suitable for playing a variety of ball games and other sports thereon and whose surfaces define playing surfaces on which playing balls normally will roll substantially equally free in all directions and will bounce substantially equally true in all directions, each of the two embodiments of the improved simulated grass pile fabric is composed of a combination of particular types of synthetic warp yarns, filling yarns, and pile yarns. That is, the warp yarns 12, 12*a* of the respective simulated grass pile fabrics 10, 10*a* preferably comprise continuous multifilament polyester yarns of a size within the range of about 1300 to 3000 denier or spun polyester yarns of equivalent size. The filling yarns 13, 13*a* of the respective fabrics 10, 10*a* each comprise a fibrillated continuous filament synthetic strand of a yarn size within the range of about 2200 to 4400 denier. The fibrillated yarn desirably used for the filling may be polypropylene.

Figure 12:
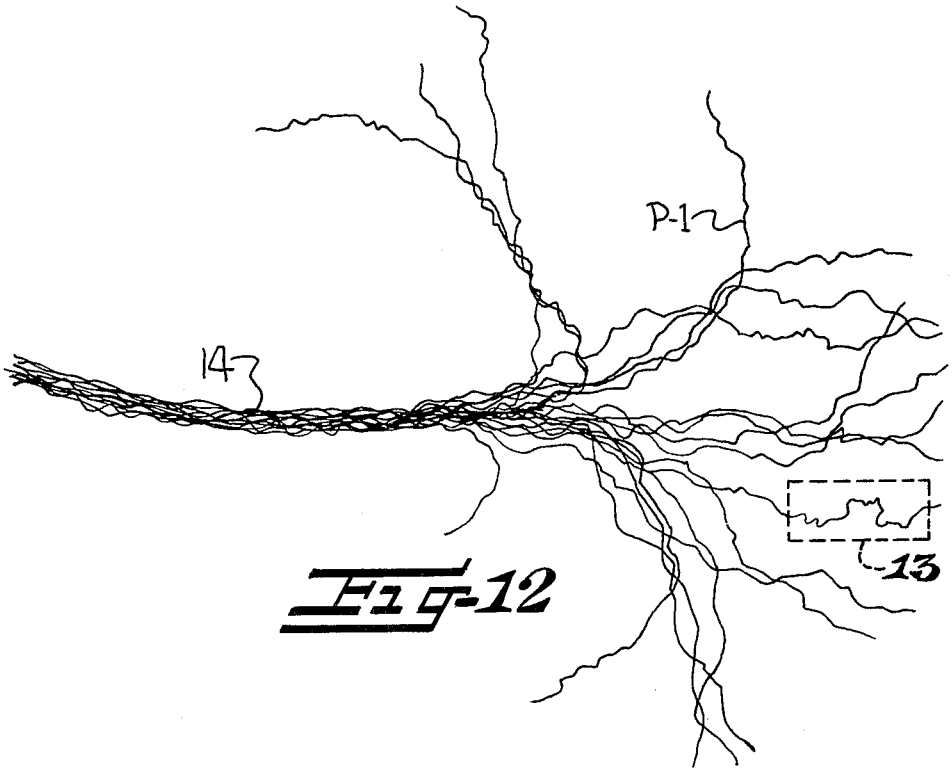
FIG. 12 is a fragmentary view of one end portion of a preferred form of a multifilament yarn used in forming the simulated grass pile fabric of the present invention.
Figure 13:
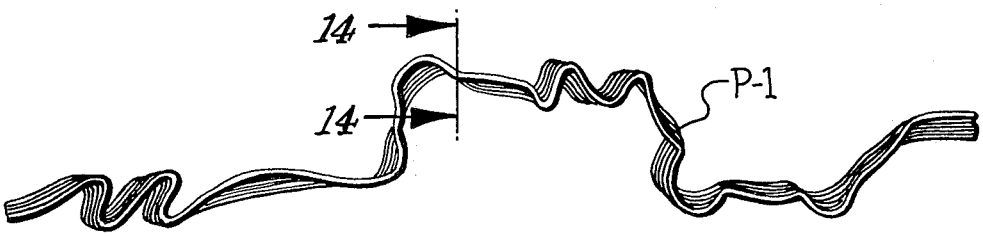
FIG. 13 is a greatly enlarged fragmentary elevational view of one of the filaments of the yarn shown in FIG. 12 as represented by the area 13 defined in broken lines in that Figure.
Figure 14:
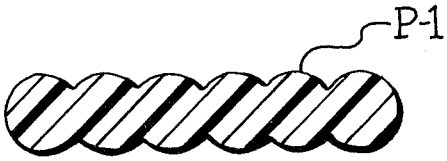
FIG. 14 is a further enlarged transverse sectional view through the filament of FIG. 13 taken substantially along line 14—14 in that Figure.

According to the invention, each pile yarn 14, 14*a* of the respective fabrics 10, 10*a* is of the type illustrated in FIGS. 12, 13 and 14 and comprises a textured multifilament synthetic yarn, preferably nylon, of a yarn size greater than about 4500 denier and having about 15 to 30 filaments P-1 therein. As preferred, each nylon filament P-1 of each pile yarn 14, 14*a* is of a ribbed generally ribbon-like form, as best shown in FIGS. 13 and 14. Also, each filament P-1 is of about 150 to 300 denier and is crimped at closely spaced points throughout its length to impart sinuosity to each filament P-1 along the length thereof, as best shown in FIGS. 12 and 13. As further illustrated in FIG. 12, the crimped filaments in each pile yarn are randomly oriented relative to each other to enhance the bulk of the pile yarns. It should be noted that there is a substantial increase in the size of the multifilament yarn during texturizing. For example, a type "6" nylon yarn composed of eighteen filaments of 250 denier per filament had a denier of 4500 in the untextured state, but after texturing, the same yarn had a denier of about 5275.

Referring again to the filling yarns 13, 13*a* of the respective simulated grass pile fabrics 10, 10*a*, it is to be noted that the filling yarns are of hydrophobic nature and are fibrillated so as to interrupt the monofilament character thereof and thus present a hairnet-like appearance thereto when the yarn is inspected while in a laterally spread-out condition. Such fibrillation of the filling yarns enhances the bulkiness thereof for providing a more effective filling of small voids around the bights of the pile yarns in the fabrics, especially in the woven type simulated grass pile fabric 10. The use of the latter type of relatively bulky filling yarns also permits economies in the production of the fabrics. For example, it has been determined that two of the fibrillated strands serve effectively in the place of four strands of conventional unfibrillated yarn of the same denier and, in fact, present more desirable bulk than the four unfibrillated yarns. Thus, even though the cost of a given unit weight of fibrillated polypropylene monofilament yarn may be about twice that of the same unit weight of unfibrillated yarn, the lesser weight of the fibrillated yarn is also quite advantageous.

By utilizing pile yarns of the type shown in FIG. 12 producing a textured multifilament yarn of more than 4500 denier, it can be appreciated that substantial bulk is present in such textured multifilament yarns so that the pile yarns 14, 14*a* in the respective simulated grass pile fabrics 10, 10*a* present a relatively condense or compact pile surface on each such fabric, while pile surface is substantially macroscopically devoid of any grain or direction of lay of the pile tufts, as best shown in FIGS. 1 and 2 and FIGS. 6 and 7 of the respective simulated grass pile fabrics 10, 10*a*.

Utilizing warp, filling and pile yarns in the yarn size ranges and of the types heretofore described in producing the woven simulated grass pile fabric 10, it is preferred that the woven fabric is provided with about 7 to 9 weftwise rows of U-shaped pile tufts per inch (2.76 to 3.54 rows per cm) in the lengthwise or warpwise direction of the fabric and about 4.5 to 5.5 warpwise rows of tufts per inch (1.77 to 2.17 rows per cm) in the widthwise or fillingwise direction.

As an example of a typical woven simulated grass pile fabric 10 produced in accordance with this invention, a fabric was formed generally in the manner heretofore described in which each of the warp yarns 12 was a 6s/3 spun staple polyester yarn, about equivalent in size to a 2660 denier continuous filament yarn, and in which the warp yarns 12 were interwoven in groups of four (see FIG. 3) with fibrillated polypropylene monofilament filling yarns 13 in groups of four, each filling yarn being of about 4400 denier. Warpwise rows of U-shaped cut pile tufts were arranged in alternation with the groups of warp yarns. The pile tufts were formed of textured multifilament nylon pile yarns 14 each having eighteen crimped filaments therein and each filament being 250 denier. The total denier of each pile yarn was about 5275 after texturing, as indicated earlier herein. The fabric was provided with about 7.5 weftwise rows of U-shaped pile tufts per inch (2.95/cm) in the lengthwise direction of the fabric and about 5 warpwise rows of tufts per inch (1.97/cm) in the widthwise direction of the fabric, and the height of the pile tufts above the base 11 was about 5/16 to ⅜ inch (7.938 to 9.525 mm). The back of the base 11 was then coated with latex. Such exemplary woven fabric weighed about 34 ounces per square yard before the latex backing was applied thereto.

Figure 8:
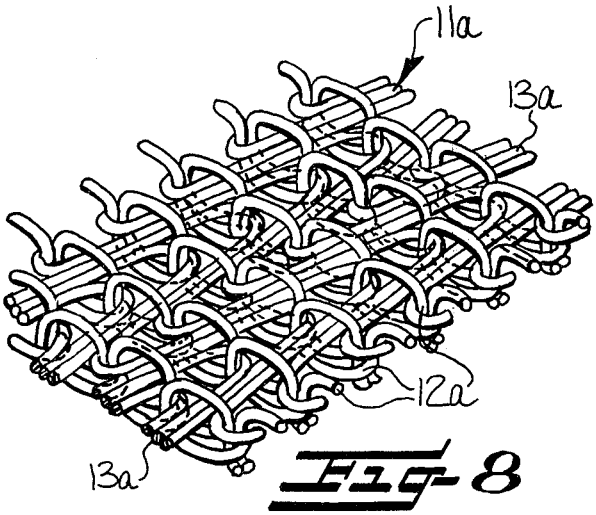
FIG. 8 is a fragmentary schematic perspective view looking downwardly upon a portion of the warp knit fabric of FIGS. 6 and 7 but omitting the pile tufts for purposes of clarity.
Figure 9:
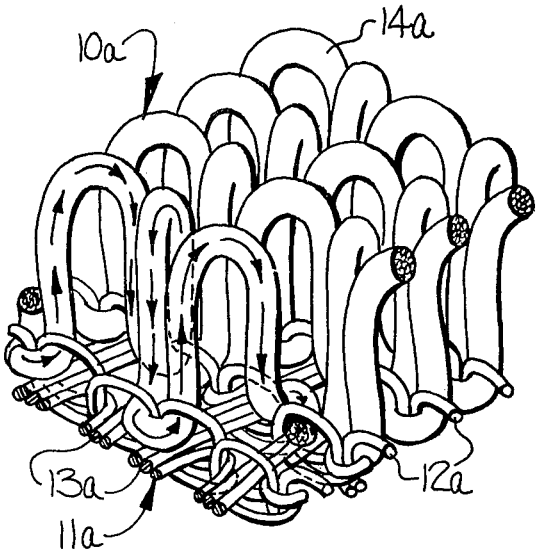
FIG. 9 is a view similar to FIG. 8, but schematically illustrating the manner in which the pile yarns are interlaced with the warp knit base, and showing the pile yarns schematically before the tufts formed therefrom the cut.
Figure 10:
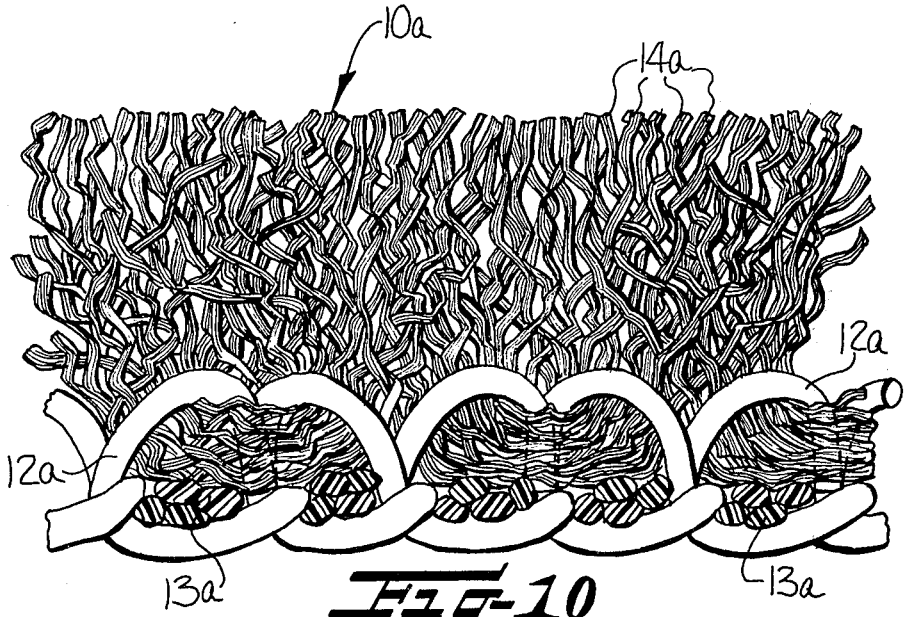
FIG. 10 is an enlarged fragmentary warpwise sectional view through the warp knit simulated grass pile fabric.
Figure 11:
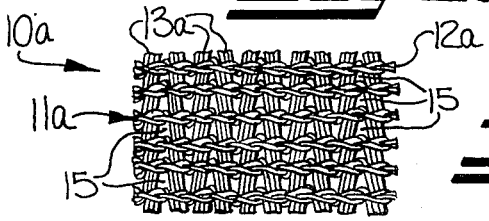
FIG. 11 is a back or bottom view of the warp knit pile fabric or FIG. 6.

Referring now to the warp knit simulated grass pile fabric 10*a* more in detail (FIGS. 6–11), essentially, the various yarns thereof are interlaced generally in the manner disclosed in U.S. Pat. No. 3,140,592 of July 14, 1964, for example. Accordingly, as shown in FIGS. 8, 9 and 10, the warp yarns 12*a* of the warp knit fabric are in the form of spaced apart parallel rows of chain stitches in which groups of the filling yarns 13*a* are laid in a zig-zag or sinuous manner generally warpwise of the warp knit fabric and interconnecting adjacent warpwise rows of the chain stitches. In this instance, each filling yarn 13*a* is shown in FIG. 8 extending between and interconnecting four rows of chain stitches formed of the warp yarns 12*a*. However, it is to be understood that each filling yarn 13*a* may extend between a greater or lesser number of rows of chain stitches, as desired, without departing from the invention.

Figure 6:
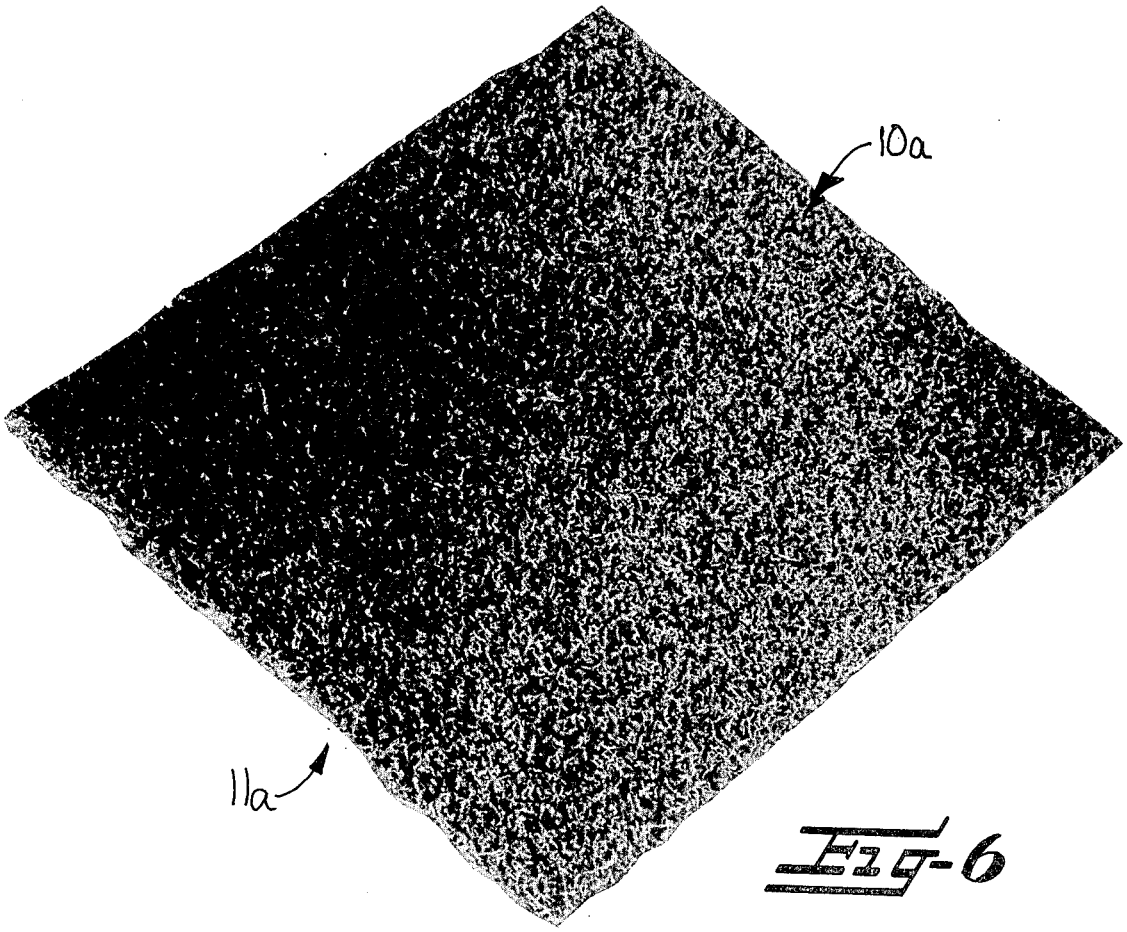
FIG. 6 is a photographic view similar to FIG. 1, but illustrating a warp knit embodiment of the improved simulated grass pile fabric of the present invention.
Figure 7:
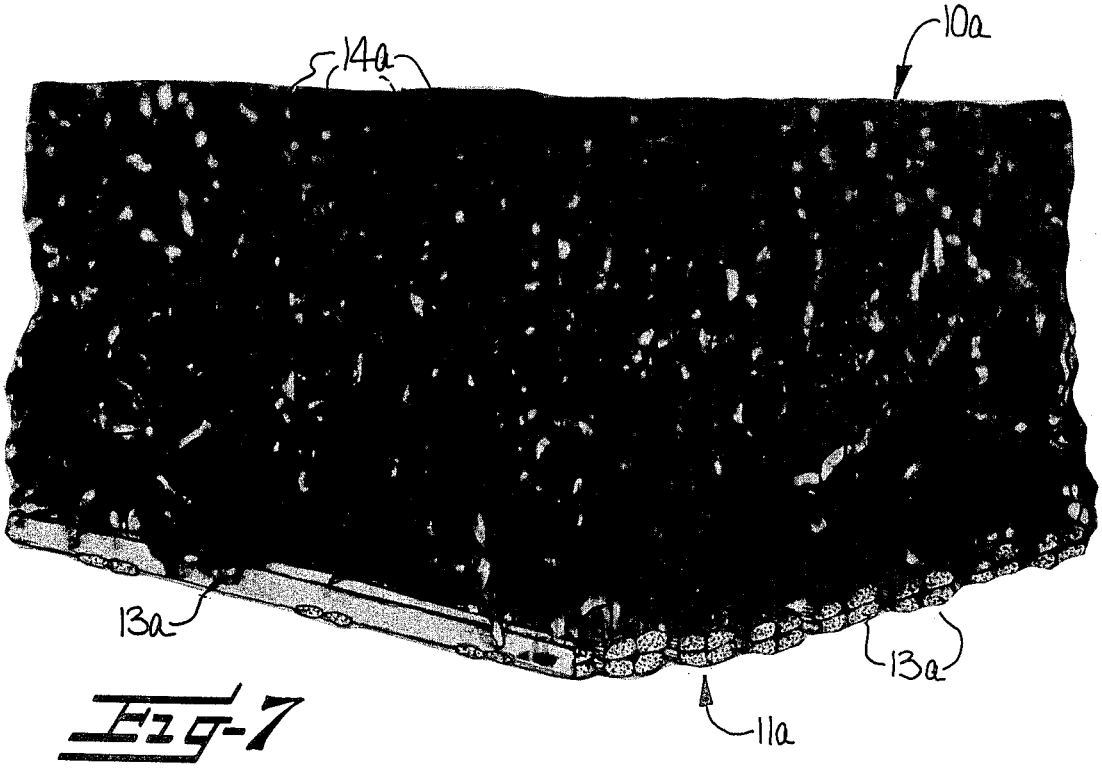
FIG. 7 is an enlarged photographic view of the lower corner portion of the pile fabric of FIG. 6.

Although the pile yarns 14*a* are cut in the finished fabric as shown in FIGS. 6, 7 and 10, in order to illustrate the preferred manner in which the fabric is constructed, it will be observed in FIG. 9 that the pile yarns 14*a* are looped through the rows of stitches formed of the warp yarns 12*a*, with the lower bights of the pile yarns being disposed above and being substantially shielded underneath by the strands of filling yarns 13*a*. As preferred, a separate pile yarn 14*a* is provided for each warpwise row of interconnected chain stitches, and each pile yarn 14*a* generally extends in a substantially warpwise direction. However, each pile yarn zig-zags back and forth between two immediately adjacent rows of chain stitches so that a row of pile loops is initially formed from a respective pile yarn 14*a* between each adjacent pair of warpwise rows of chain stitches of the warp yarns 12*a*. As best illustrated in FIGS. 6, 7 and 10, it is desirable that the warp knit fabric 10*a* be of relatively high density. Even so, it will be observed in FIG. 11 that adjacent rows of chain stitches formed of warp yarns 12*a* are spaced apart from each other so as to provide relatively small openings 15 spaced throughout the base 11*a* of the fabric 10*a* for imparting porosity to the warp knit type of simulated grass pile fabric to facilitate drainage of water through the fabric when in use on a playing surface such as a baseball field or a football field. In producing the warp knit simulated grass pile fabric, utilizing yarns in the yarn size ranges and of the types described heretofore, it is preferred that the warp knit fabric 10*a* is provided with about 5.8 to 6.2 weftwise rows of U-shaped pile tufts per inch (2.28 to 2.44/cm) in the warpwise or lengthwise direction of the fabric and about 5.8 to 6.2 warpwise rows of pile tufts per inch in the weftwise or widthwise direction of the fabric.

As an example of a typical warp knit simulated grass pile fabric 10*a* produced in accordance with this invention, a warp knit fabric was formed generally in the manner heretofore described with reference to FIGS. 8, 9, 10 and 11 in which each longitudinal row of chain stitches was formed from one of the chain stitch warp yarns 12*a* was of about 1300 denier continuous filament polyester material interknit, as in FIGS. 8 and 9, with fibrillated polypropylene monofilament filling yarns 13*a* each being of about 2200 denier, and with warpwise rows of U-shaped cut pile tufts arranged in alternation with the chain stitch warp yarns. Four such filling yarns 13*a* passed through each chain stitch, as shown. The pile tufts were formed of textured multifilament nylon pile yarns 14*a* each having eighteen crimped filaments therein and each filament being about 250 denier. The total denier of each pile yarn 14*a* was about 5275 after texturing, as indicated earlier herein. The warp knit fabric 10*a* was provided with about 6.0 rows of generally U-shaped pile tufts per inch (2.36/cm) in the lengthwise direction of the fabric and about 6.0 rows of pile tufts per inch (2.36/cm) in the widthwise direction of the fabric, and the height of the cut pile tufts above the base or ground fabric 11*a* was about 5/16 to ⅜ inch (7.938 to 9.525 mm). The back of the base 11*a* also was coated with latex to enhance the stability and integrity of the fabric without closing the drainage openings 15.

As shown in the photographs of FIGS. 1, 2, 6 and 7, it can be appreciated that the pile faces of the fabrics 10, 10*a* are macroscopically devoid of any grain or direction of lay of the pile tufts thereof, thus providing more improved traction and reduced slippage for persons playing sports thereon than is the case with other simulated grass pile fabrics in which all, or essentially all, the pile tends to lean in a generally common direction. Such improved traction also contributes to the safety of persons using the fabrics. Further, by avoiding a grain or direction of lay of the pile tufts, it can be appreciated that a ball will bounce truer and will roll freely in all directions along the pile surface of each of the fabrics 10, 10*a* when in use on generally smooth and generally level playing fields. By utilizing the bulky pile yarns 14, 14*a* having the crimped, randomly oriented filaments P-1 (FIGS. 12–14) therein, the fabrics 10, 10*a* are of high density, and wearability of the fabrics is enhanced as well as the fabrics having improved inherent barriers to the sun's ultraviolet rays, since adjacent pile tufts and filaments tend to shield and protect each other from the adverse discoloration effects of such rays.

In the drawings and specification, there have been set forth preferred embodiments of the invention, and although specific terms are employed, they are used in a generic and descriptive sense only, and not for purposes of limitation, the scope of the invention being defined in the claims.

That which is claimed is:

1. A simulated grass pile fabric of the woven or warp knit type for playing a variety of ball games and other sports thereon and characterized in that the surface of the pile fabric defines a playing surface on which the playing ball rolls substantially equally free in all directions and bounces substantially equally true in all directions to provide for the safer playing of sports thereon, said fabric comprising a base of interlaced warp and filling yarns, and pile yarns interlaced with the base and extending upwardly therefrom and defining cut pile tufts forming a pile face on the fabric, and wherein said warp yarns comprise synthetic yarns of a yarn size within the range of about 1300 to 3000 denier, said filling yarns each comprise a fibrillated synthetic strand of a yarn size within the range of about 2200 to 4400 denier, and said pile yarns comprise textured multifilament yarns of a yarn size greater than 4500 denier, and wherein each of the filaments thereof is ribbon-like and of about 150 to 300 denier and is crimped to impart sinuosity thereto throughout its length, with the crimped filaments being randomly oriented relative to each other to enhance the bulk of the pile yarns, said pile yarns are arranged in warpwise and fillingwise rows of cut pile tufts, and wherein the pile on the fabric is substantially macroscopically devoid of any grain or direction of lay of the pile tufts to thereby present a simulated grass surface for playing a variety of ball games and other sports thereon and wherein the playing ball rolls substantially equally free in all directions and bounces substantially true in all directions.

2. A simulated grass pile fabric according to claim 1 wherein said pile yarns are of a yarn size of about 5275 denier.

3. A simulated grass pile fabric according to claim 1 or 2 wherein said cut pile tufts are generally U-shaped and are of about 5/16 to ¾ inch (7.938 to 9.525 mm) high above said base.

4. A simulated grass pile fabric according to of claim 1 or 2 wherein said warp yarns are staple polyester yarns, said filling yarns are fibrillated polypropylene monofilament strands, and said pile yarns are textured nylon.

5. A woven simulated grass pile fabric for playing a variety of ball games and other sports thereon and characterized in that the surface of the pile fabric defines a playing surface on which the playing ball rolls substantially equally free in all directions and bounces substantially equally true in all directions to provide for the safer playing of sports thereon, said fabric comprising a base of interwoven warp and filling yarns, and pile yarns interwoven with the base and extending upwardly therefrom and defining cut pile tufts forming a pile face on the fabric, and wherein said warp yarns comprise spun staple polyester yarns of a yarn size within a range equivalent to about 1300 to 2200 denier, said filling yarns each comprise a fibrillated polypropylene monofilament strand of a yarn size within the range of about 2200 to 4400 denier, and said pile yarns comprise textured multifilament nylon yarns of a yarn size greater than 4500 denier, and wherein each of the filaments thereof is ribbon-like and of about 150 to 300 denier and is crimped to impart sinuosity thereto throughout its length, with the crimped filaments being randomly oriented relative to each other to enhance the bulk of the pile yarns, said cut pile tufts are arranged in weftwise rows of about 7 to 9 weftwise rows of tufts per warpwise inch (2.76 to 3.54 rows per cm) of fabric, and wherein the pile on the fabric is substantially macroscopically devoid of any grain or direction of lay of the pile tufts to thereby present a simulated grass surface for playing a variety of ball games and other sports thereon and wherein the playing ball rolls substantially equally free in all directions and the ball bounces substantially equally true in all directions.

6. A woven simulated grass fabric according to claim 5 wherein said cut pile tufts are also arranged in warpwise rows of about 4.5 to 5.5 rows per weftwise inch (1.77 to 2.17 rows per cm) of the fabric.

7. A warp knit simulated grass pile fabric for playing a variety of ball games and other sports thereon and characterized in that the surface of the pile fabric defines a playing surface on which the playing ball rolls substantially equally free in all directions and bounces substantially equally true in all directions to provide for the safer playing of sports thereon, said fabric comprising a base of warp yarns forming warpwise rows of chain stitches interlaced with filling yarns laid in the rows of chain stitches, and pile yarns interlaced with the base and extending upwardly therefrom and defining cut pile tufts forming a pile face on the fabric, and wherein said warp yarns forming said chain stitches comprise continuous filament polyester yarns of a yarn size within the range of about 1300 to 3000 denier, said filling yarns each comprise a fibrillated polypropylene monofilament strand of a yarn size within the range of about 2200 to 4400 denier, and said pile yarns comprise textured multifilament nylon yarns of a yarn size greater than 4500 denier, and wherein each of the filaments thereof is ribbon-like and of about 150 to 300 denier and is crimped to impart sinuosity thereto throughout its length, with the crimped filaments being randomly oriented relative to each other to enhance the bulk of the pile yarns, said pile yarns are arranged in warpwise and fillingwise rows of cut pile tufts, and wherein the pile on the fabric is substantially macroscopically devoid of any grain or direction of lay of the pile tufts to thereby present a simulated grass surface for playing a variety of ball games and other sports thereon and wherein the playing ball rolls substantially equally free in all directions and bounces substantially equally true in all directions.

8. A warp knit simulated grass fabric according to claim 7 wherein each warpwise and fillingwise row of cut pile tufts includes about 4.5 to 5.5 tufts per inch of the fabric (2.28 to 2.44/cm).

9. A woven simulated grass pile fabric for playing a variety of ball games and other sports thereon and characterized in that the surface of the pile fabric defines a playing surface on which the playing ball rolls substantially equally free in all directions and bounces substantially equally true in all directions to provide for the safer playing of sports thereon, said fabric comprising a base of interwoven warp and filling yarns, and pile yarns interwoven with the base and extending upwardly therefrom and defining cut pile tufts forming a pile face on the fabric, and wherein said warp yarns comprise spun staple polyester yarns each of a yarn size of about 6s/3 of the cotton system, said filling yarns each comprise a fibrillated polypropylene monofilament strand of a yarn size of about 4400 denier, and said pile yarns each comprise a textured multifilament nylon yarn of a yarn size greater than 4500 denier, and wherein each of the filaments thereof is ribbon-like and of about 150 to 300 denier and is crimped to impart sinuosity thereto throughout its length, with the crimped filaments being randomly oriented relative to each other to enhance the bulk of the pile yarns, said cut pile tufts are arranged in weftwise rows of about 7.5 weftwise rows of generally U-shaped tufts per warpwise inch (2.95 rows per cm) of fabric and in warpwise rows of about 5 tufts per weftwise inch (1.97 rows per cm), and wherein the pile on the fabric is substantially macroscopically devoid of any grain or direction of lay of the pile tufts to thereby present a simulated grass surface for playing a variety of ball games and other sports thereon and wherein the playing ball rolls substantially equally free in all directions and the ball bounces substantially equally true in all directions.

10. A warp knit simulated grass pile fabric for playing a variety of ball games and other sports thereon and characterized in that the surface of the pile fabric defines a playing surface on which the playing ball rolls substantially equally free in all directions and bounces substantially equally true in all directions to provide for the safer playing of sports thereon, said fabric comprising a base of warp yarns forming warpwise rows of chain stitches interlaced with filling yarns laid in the rows of chain stitches, and pile yarns interlaced with the base and extending upwardly therefrom and defining cut pile tufts forming a pile face on the fabric, and wherein said warp yarns forming said chain stitches comprise continuous filament polyester yarns of a yarn size of about 1300 denier, said filling yarns each comprise a fibrillated polypropylene monofilament strand of a yarn size of about 2200 denier, and said pile yarns comprise textured multifilament nylon yarns of a yarn size greater than 4500 denier, and wherein each of the filaments thereof is ribbon-like and of about 150 to 300 denier and is crimped to impart sinuosity thereto throughout its length, with the crimped filaments being randomly oriented relative to each other to enhance the bulk of the pile yarns, said pile yarns are arranged in warpwise and fillingwise rows of cut pile tufts, there being about 6 rows of generally U-shaped pile tufts per inch (2.36/cm) in each of the warpwise direction and the weftwise direction of the fabric, and wherein the pile on the fabric is substantially macroscopically devoid of any grain or direction of lay of the pile tufts to thereby present a simulated grass surface for playing a variety of ball games and other sports thereon and wherein the playing ball rolls substantially equally free in all directions and bounces substantially equally true in all directions.

* * * * *

UNITED STATES PATENT AND TRADEMARK OFFICE

CERTIFICATE OF CORRECTION

PATENT NO. : 4,381,805

DATED : May 3, 1983

INVENTOR(S) : James E. Troy

It is certified that error appears in the above-identified patent and that said Letters Patent are hereby corrected as shown below:

Column 2, line 9, "the" should be --are--.

Column 2, line 47, "is" should be --in--.

Column 4, line 14, "while" should be --which--.

Claim 3, Column 6, line 64, "3/4" should be --3/8--.

Signed and Sealed this

*Twenty-third* Day of *August 1983*

[SEAL]

*Attest:*

GERALD J. MOSSINGHOFF

*Attesting Officer*

*Commissioner of Patents and Trademarks*